US007959276B2

(12) United States Patent
Muhl

(10) Patent No.: US 7,959,276 B2
(45) Date of Patent: Jun. 14, 2011

(54) CONFIGURATION FOR EXCHANGING INKJET PRINTING MODULES

(75) Inventor: Wolfgang Muhl, Hohen Neuendorf (DE)

(73) Assignee: Francotyp-Postalia GmbH, Birkenwerder (DE)

( * ) Notice: Subject to any disclaimer, the term of this patent is extended or adjusted under 35 U.S.C. 154(b) by 1033 days.

(21) Appl. No.: 11/818,799

(22) Filed: Jun. 15, 2007

(65) Prior Publication Data

US 2008/0018705 A1 Jan. 24, 2008

(30) Foreign Application Priority Data

Jul. 21, 2006 (DE) ..... 10 2006 034 611

(51) Int. Cl.
*B41J 2/18* (2006.01)

(52) U.S. Cl. ..... 347/87

(58) Field of Classification Search ..... 347/85–87
See application file for complete search history.

(56) References Cited

U.S. PATENT DOCUMENTS

| | | | | |
|---|---|---|---|---|
| 5,646,665 | A * | 7/1997 | Swanson et al. | 347/87 |
| 5,798,777 | A | 8/1998 | Yoshimura et al. | |
| 5,880,747 | A | 3/1999 | Bartenwerfer et al. | |
| 6,170,940 | B1 * | 1/2001 | Shinada et al. | 347/86 |
| 6,250,750 | B1 | 6/2001 | Miyazawa et al. | |
| 6,280,018 | B1 | 8/2001 | Belon et al. | |
| 6,367,911 | B1 | 4/2002 | Windel et al. | |
| 6,390,577 | B1 | 5/2002 | Fajour | |
| 6,406,120 | B2 * | 6/2002 | Pauschinger | 347/19 |
| 2004/0160480 | A1 | 8/2004 | Kulpa et al. | |
| 2005/0007420 | A1 | 1/2005 | Ogawa et al. | |

FOREIGN PATENT DOCUMENTS

| | | | |
|---|---|---|---|
| DE | 44 24 771 | C1 | 11/1995 |
| DE | 196 05 014 | C1 | 3/1997 |
| DE | 29711899 | U1 | 10/1997 |
| DE | 200 12 945 | U1 | 11/2000 |
| EP | 0 622 208 | A2 | 11/1994 |
| EP | 0 696 509 | B1 | 2/1996 |
| EP | 0710568 | A2 | 5/1996 |
| EP | 1 484 182 | A1 | 12/2004 |

OTHER PUBLICATIONS

European Search Report dated Jun. 4, 2009.

* cited by examiner

*Primary Examiner* — Mark A Robinson
*Assistant Examiner* — Erin D Chiem
(74) *Attorney, Agent, or Firm* — Laurence A. Greenberg; Werner H. Stemer; Ralph E. Locher

(57) ABSTRACT

A configuration for exchanging inkjet printing modules in a franking and/or addressing machine having a shaft-shaped receptacle with a locking device for the inkjet printing modules. The functional reliability and an extension of the service life of the printing device are improved by achieving simple and reliable exchanging of the inkjet printing module. In particular, easy drawing of the inkjet printing module is made possible and mechanical impairment of the mating contacts for the inkjet printing module is prevented. Devices are provided for pulling and releasing the contact of the inkjet printing module in the receptacle. These devices are coupled mechanically to one another in such a way that, when the pulling process is initiated, contact is released at the same time. A wiping apparatus is arranged in the pivoting region of the rear edge of the nozzle surface of the inkjet print head.

4 Claims, 9 Drawing Sheets

CONFIGURATION FOR EXCHANGING INKJET PRINTING MODULES

CROSS-REFERENCE TO RELATED APPLICATION

This application claims the priority, under 35 U.S.C. §119, of German patent application DE 10 2006 034 611.4, filed Jul. 21, 2006; the prior application is herewith incorporated by reference in its entirety.

BACKGROUND OF THE INVENTION

FIELD OF THE INVENTION

The invention relates to a configuration for exchanging inkjet printing modules or inkjet printing cartridges, in particular in a franking and/or addressing machine.

It has proven expedient also to utilize the advantages of inkjet printing in the field of machine franking and/or addressing. Here, printing takes place without contact by means of an inkjet print head. See, for example, commonly assigned German patent DE 44 24 771 C1 and its counterpart U.S. Pat. No. 6,367,911 B1, as well as European patent EP 0 696 509 B1 and its counterpart U.S. Pat. No. 6,390,577 B1.

When commercially available inkjet print heads for office printers are used, the latter are as a rule a constituent part of an inkjet printing module. That is to say, the inkjet print head and cartridge form one unit.

In the office printer, the inkjet printing module is arranged in a shaft-shaped receptacle apparatus in a lockable and positively guided manner. When the ink has been used up, the inkjet printing module has to be exchanged. This takes place by manual pulling. To this end, first of all a locking lever is released, the inkjet printing module is gripped with two fingers at one gripping corner and pulled obliquely past the locking lever, see, for example, the user manual for HP DeskJet 1220C of 10/1999.

In contrast to the space conditions in office printers, the accessibility to the inkjet printing modules in franking machines is substantially more restricted, with the result that exchanging is problematic.

A franking machine having a printing system with two inkjet printing modules and an associated cleaning and sealing apparatus is described in the commonly assigned, copending patent application Ser. No. 11/589,268, filed Oct. 26, 2006, and its German counterpart DE 10 2005 052 150.

The printing system comprises a frame, two inkjet printing modules and an assigned double-compartment shaft-shaped receptacle for the two.

Each inkjet printing module comprises an inkjet print head in addition to an ink supply, a chip and a contact field. The mating contacts are attached in the receptacle in an adapted manner.

The inkjet printing modules are arranged in parallel but offset with respect to one another, in order to achieve the required printing gap length.

The receptacle is mounted such that it can be pivoted about a pin which is fastened in the frame. In order to prime and to seal the inkjet print head, the receptacle is pivoted out of the printing position into a position to such an extent that the nozzle surface of the latter is directed downward. This is at the same time the position, in which exchanging of the inkjet printing module is possible.

The printing position and the sealing position are accordingly determined by clearly defined positions of the inkjet print head and the cleaning and sealing apparatus.

In addition, various cleaning regions are provided. In one cleaning region in front of the sealing position, the inkjet print head is pivoted out of the printing position to such an extent that the nozzle surface is arranged in the engagement region of the wiping lips of the cleaning and sealing apparatus. During the wiping process, the wiping lips wipe both over the nozzle surface and along two side edges, as a result of which residual ink deposits are produced on the latter. When the inkjet printing module is pulled, these deposits can contaminate the mating contacts and accordingly endanger the functional reliability of the printing device.

This effect is reinforced further if the printing device is provided with an additional ink supply system, as substantially more wiping operations and therefore greater deposits occur in this case.

A further problem consists in that, during pulling out or plugging in of the inkjet printing module, the abovementioned edge slides along the mating contacts and the latter are damaged as a result. The greater the clearance during exchanging, the greater also the risk of faulty guiding and accordingly of wear.

The purpose of the invention is an improvement in the functional reliability and an extension of the service life of the printing device.

SUMMARY OF THE INVENTION

It is accordingly an object of the invention to provide a configuration for exchanging ink jet printing modules which overcomes the above-mentioned disadvantages of the heretofore-known devices and methods of this general type and which allows exchanging an inkjet printing module simply and reliably in a franking and/or addressing machine. In particular, easy pulling out is to be made possible and contamination and mechanical impairment of the meeting contacts for the inkjet printing module is to be prevented.

With the foregoing and other objects in view there is provided, in accordance with the invention, a configuration for exchanging inkjet printing modules in a franking and/or addressing machine, comprising:

a shaft-shaped receptacle with a locking lug for the inkjet printing module, the inkjet printing module including an inkjet print head with a nozzle surface, a rear edge of the nozzle surface, and a chip and a contact field disposed on a narrow side adjacent the nozzle surface;

the receptacle being disposed behind a guide plate formed with a printing window, wherein printing media are guided along the guide plate for printing with the inject printing module (the printing media are guided such that they are in contact and stand on edge);

devices, in the receptacle, for pulling and decontacting the inkjet printing module, the devices being mechanically coupled to one another such that, when pulling is initiated, decontacting is effected at the same time; and a wiping apparatus disposed in a pivoting region of the rear edge of the nozzle surface of the inkjet print head.

In accordance with an added feature of the invention, the receptacle has side walls and substantially vertical recesses formed in the side walls, and further:

a draw hook for pulling the inkjet printing module disposed in an elastically adjustable manner in one of the vertical recesses of the side walls, the draws hook protruding out of the receptacle with a gripping opening and bearing by way of a rear end-side contour against an end of a shorter upper lever arm of a rotatably mounted two-armed guide lever, protruding with an end of a longer lower lever arm thereof into an adapted contour of a carrier rear wall of a carrier of the receptacle;

the draw hook is formed with a recess at the other end of the rear end-side contour adapted to a contour of an end of the shorter lever arm of the guide lever, into which recess the guide lever is latched in a case of a pressed draw hook; and a spring pin mounted in a carrier rear wall orthogonally with respect thereto, the spring pin, when the ink jet printing module is pushed in completely, bearing against a locking lug with a force-transmitting connection.

In accordance with an additional feature of the invention, there is provided a chip holder on the inkjet printing module formed with vertically extending guide webs, wherein the guide webs have beveled ends serving, during an exchange, to space the inkjet printing module away from a carrier rear wall.

In accordance with another feature of the invention, a vertically extending spring piece is let into a carrier rear wall within a counterpart to the contact field of the inkjet printing module. The spring piece, during unlocking, additionally serves to space the contact field from the counterpart.

In accordance with a further feature of the invention, the wiping apparatus comprises a pin let into a center wall of the carrier and a tubular covering pushed onto the pin.

In accordance with again an added feature of the invention, the draw hook is provided, at an end facing away from the gripping part, with a pin guided in an oblong slot of the side wall of the receptacle, and wherein a tension spring fastened at the other end to a journal is attached at a free end of the pin.

In accordance with a concomitant feature of the invention, a plurality of leaf-shaped guide springs for laterally guiding the inkjet printing modules are disposed in a lower region of the side walls and a center wall of the carrier.

Other features which are considered as characteristic for the invention are set forth in the appended claims.

Although the invention is illustrated and described herein as embodied in configuration for exchanging inkjet printing modules, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

The illustration is shown partially diagrammatically for simplification and easier understanding.

Figure 1:
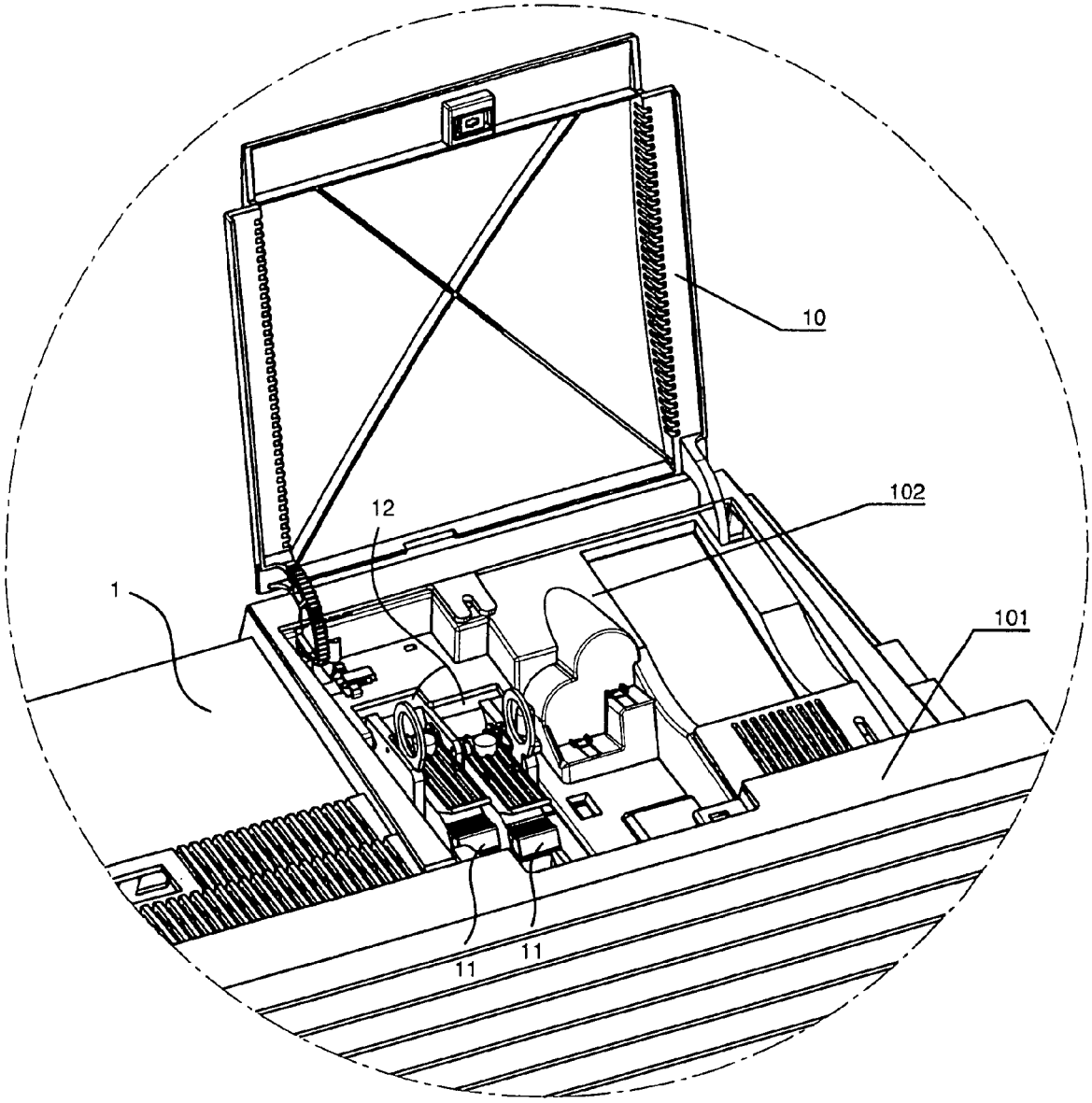
FIG. 1 shows a perspective view of the printing system in a franking machine with an open service flap, as viewed from the front left.

Referring now to the figures of the drawing in detail and first, particularly, to FIG. 1 thereof, a service flap 10 which extends as far as the region of the guide plate 101 for the printing media is provided in the covering wall of a franking machine housing 1. The service flap 10 is shown in the open state, with the result that the receptacle 12 having the two printing modules 11 can be seen. The inner cover 102 serves to prevent unauthorized access of the franking machine. The space below this can be used for additional ink tanks.

Figure 2:
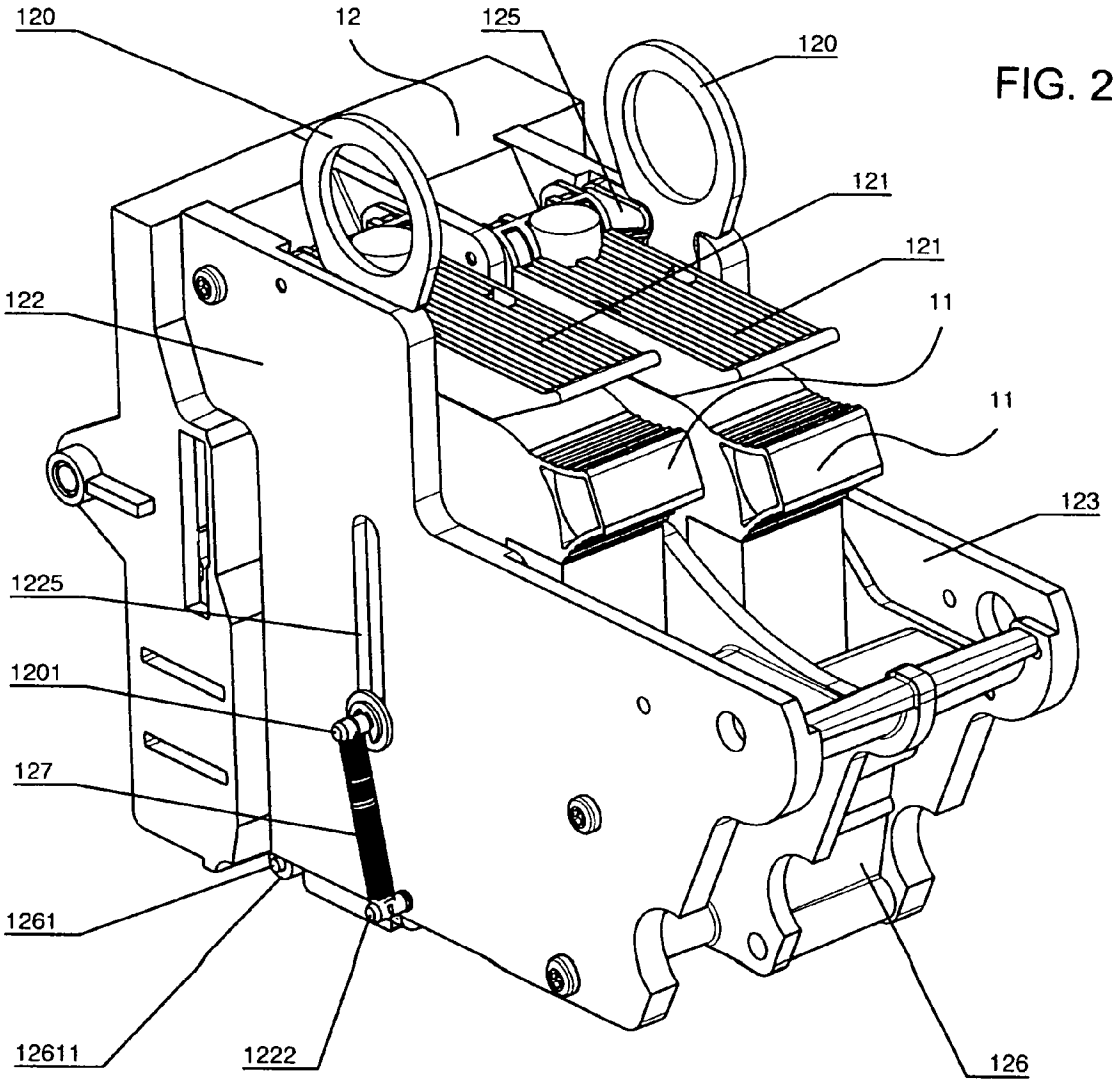
FIG. 2 shows a perspective view of the receptacle having printing modules which are pushed in, as viewed from the front left.

FIG. 2 shows a receptacle 12 for/having two printing modules 11. The printing modules 11 are pushed in completely and fixed in each case by means of an associated bolt 121. The receptacle 12 comprises two side walls 122, 123 and a common double-angled carrier 126, the fixed constituent part of which is a center wall which is not shown in further detail. In this way, two chambers are formed for receiving the printing modules 11. The side walls 122, 123 are of substantially mirror-symmetrical design (the left-hand side wall 122 is somewhat longer), with the result that the further description can be restricted to the left-hand side wall 122.

A draw hook 120 which serves to make removal of the printing module 11 easier is guided on the inside in a recess of the side wall 122. The draw hook 120 protrudes at one end upward out of the receptacle 12 and is provided at this end with a suitable gripping opening (hole). At the opposite end, a pin 1201 is fastened which protrudes through a slot 1225 in the side wall 122. A tension spring 127 is attached to the free end of the pin 1201, the other end of said tension spring 127 being fastened to a journal 1222 which is let into the side wall 122. In this way, the tension spring 127 acts as a restoring spring for the pulled draw hook 120.

A pin 1261 with a covering 12611 which is pushed onto it is let into the center wall below the lower edge of the side wall 122. The covering 12611 serves as a wiping element for the lower rear edge of the printing module 11, see also FIGS. 3 and 5 which follow.

Figure 3:
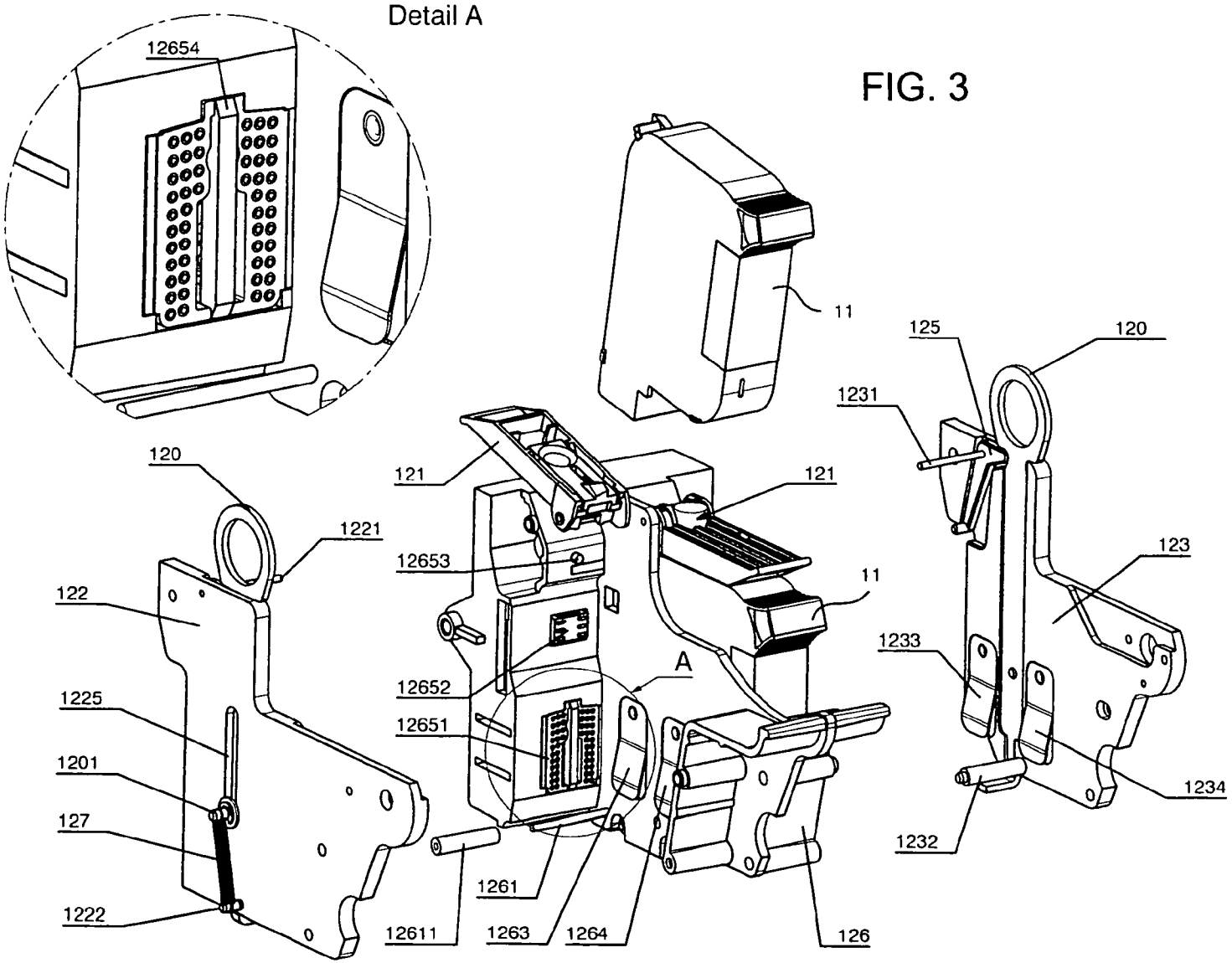
FIG. 3 shows the receptacle according to FIG. 2, partially in an exploded illustration, with a detail of the carrier rear wall.
Figure 5:
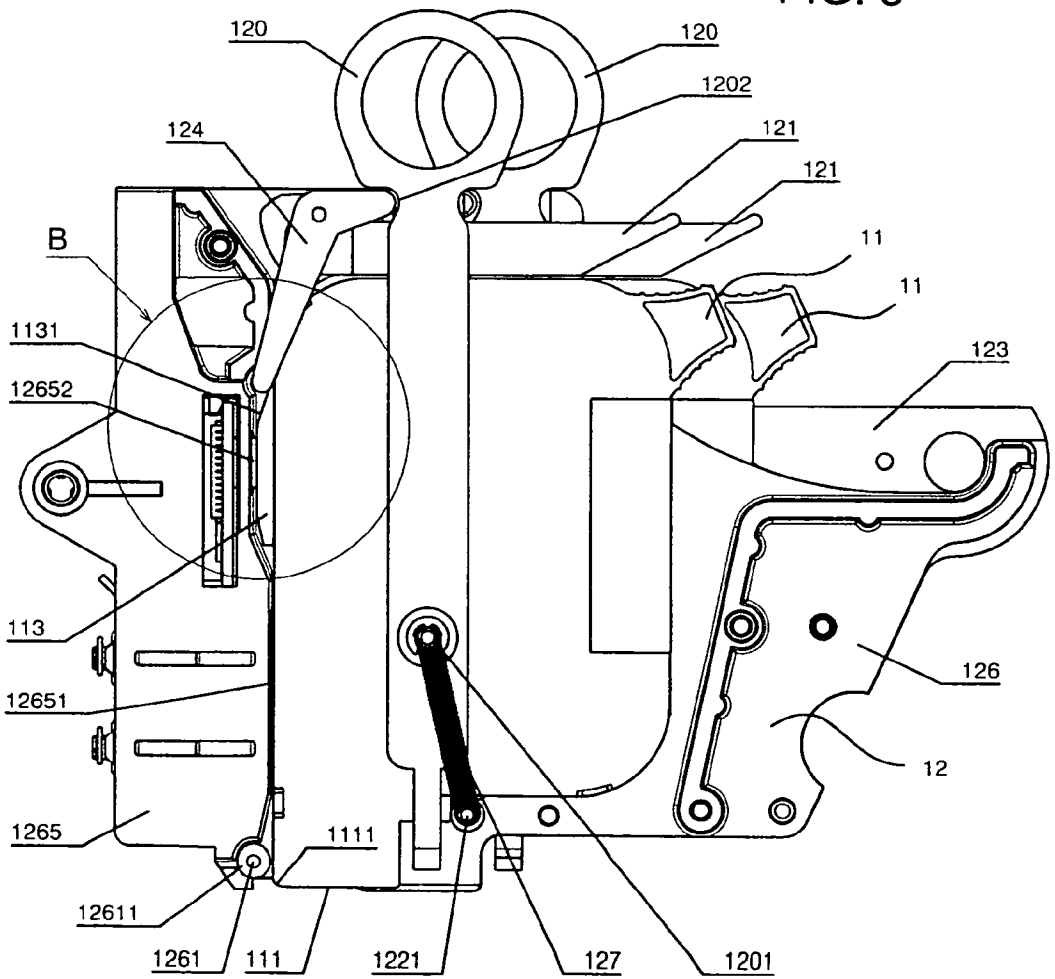
FIG. 5 shows a side view of the receptacle having printing modules which are pushed in completely, with a side wall removed, as viewed from the left with a detail of the locking mechanism.
Figure 5:
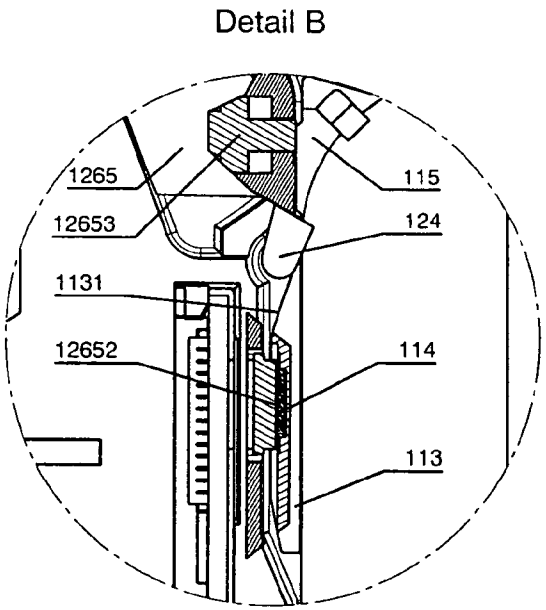

A guide lever 125 for the right-hand draw hook 120 is fastened pivotably in the right-hand side wall 123; for more details likewise see FIGS. 3 and 5 which follow.

In FIG. 3, the left-hand side wall 122 and the right-hand side wall 123 are removed, and the bolt 121 for the left-hand printing module 11 is folded back and the latter is removed. The bolt 121 for the right-hand printing module 11 is closed.

It can be seen clearly how the draw hook 120 is guided in the right-hand side wall 123 and the guide lever 125 engages into a correspondingly adapted recess (not denoted in further detail) of the draw hook 120. The guide lever 125 is mounted pivotably on a pin 1231 which is let on one side into the side wall 123 and on the other side into a lug of the rear wall of the carrier 126. The same is true analogously for the left-hand pin 1221. The pin 1231 serves at the same time as an upper connection between the right-hand side wall 123 and the carrier 126. The lower connection and spacing takes place by means of a journal 1232 which, moreover, also serves for attaching the tension spring 127 for the draw hook 120. Two guide springs 1233, 1234 which are designed as leaf springs and serve to fix the printing module 11 elastically are fastened on both sides of the guide for the draw hook 120 in the lower region of the right-hand side wall 123. In a corresponding manner, two further guide springs 1263, 1264 (not visible) are attached to the center wall of the carrier 126. In this regard, see also the guide springs 1223, 1224, 1264, 1263 at the front and the rear for the printing module 11 in the left-hand chamber of the receptacle 12.

The covering 12611 is pushed onto the pin 1261 as an exchangeable roll made from an absorbent material.

Figure 4:
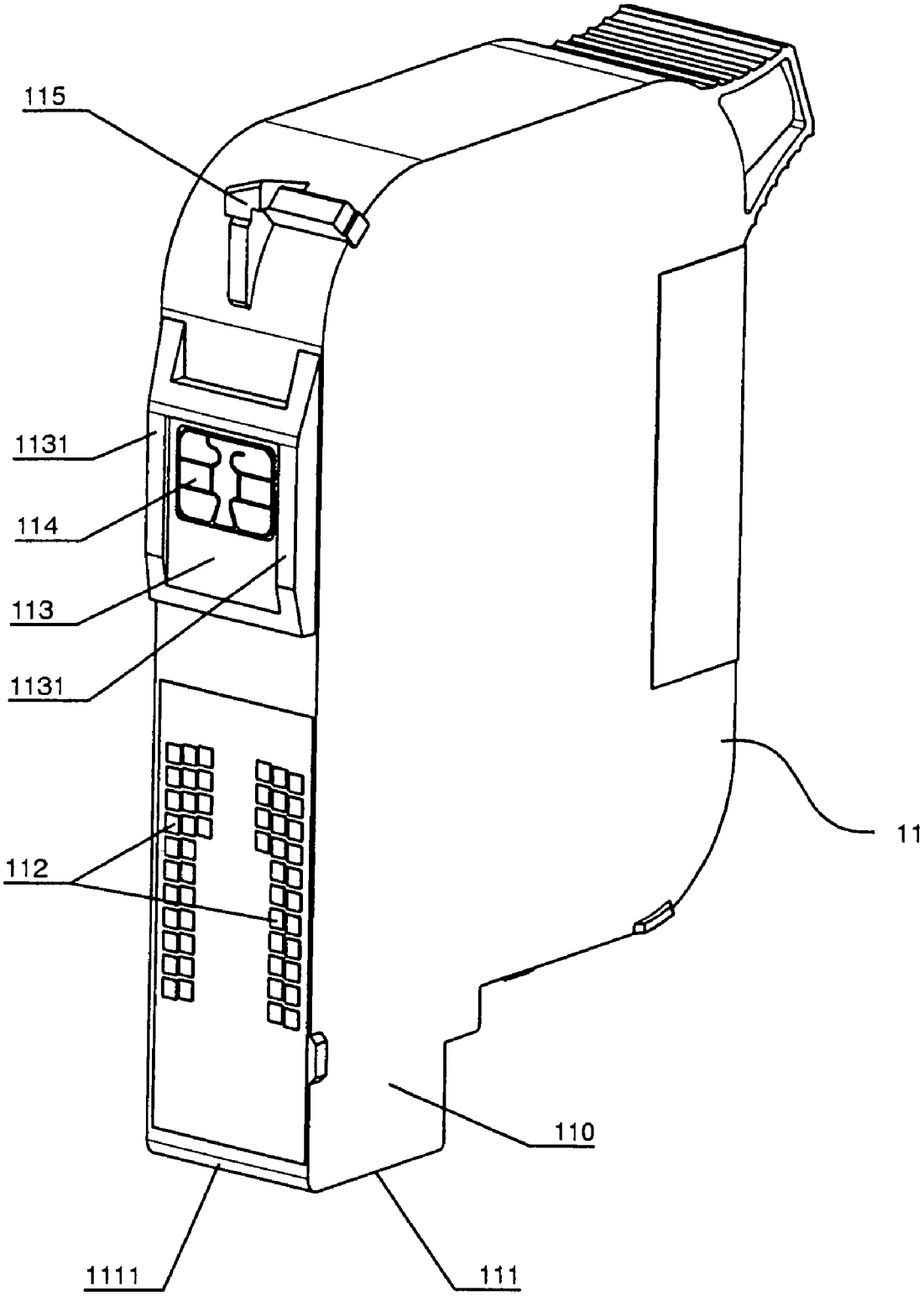
FIG. 4 shows a perspective view of a printing module, as viewed from the rear left.

A counterpart 12651 to the contact field 112 of the printing module 11 is let resiliently into the rear wall of the carrier 126 in the lower region, and a counterpart 12652 for the contact means of the module chip 114 of the printing module 11 is also let resiliently into the rear wall of the carrier 126, see also FIG. 4.

As can be seen readily in detail A, a vertically extending spring piece 12654 is used in the free region of the counterpart contact field 12651, in the form of a flat web which is beveled at the ends. This counterpart 12654 serves as a diverter for protecting the contacts. The function of a spring pin 12653 is similar, which is used above the counterpart 12652 and is released when the bolt 121 is open, in order to interrupt the electrical contact reliably.

According to FIG. 4, a commercially available printing module 11 comprises, in the lower part, an inkjet print head 110 having a nozzle surface 111 which is situated on the base and has a rounded rear edge 1111. In the region of the inkjet print head 110, the contact field 112 is situated on the rear side of the printing module 11 in the form of two angles which are arranged at a spacing from one another in a mirror-symmetrical manner. The chip holder 113 having the module chip 114 is arranged above the contact field 112. The chip holder 113 has guide webs 1131 which extend vertically on the sides, and is beveled at the top and the bottom.

A locking lug 115 which is adapted to the contour of the bolt 121 is formed integrally on the rounded upper rear edge of the printing module 11. A gripping part (not designated in greater detail) is provided in the front upper part.

FIG. 5 shows the positional relationships in printing modules 11 which have been pushed in completely and locked, with the left-hand side wall 122 removed. The bolts 121 rest on the upper side of the printing modules 11 with a force-transmitting connection. The rear side of the printing modules 11 bears against the carrier rear wall 1265 in parallel. The nozzle surfaces 111 of the inkjet print heads 110 protrude parallel to one another and to the underside of the carrier 126 out of said carrier 126. The roll 12611 bears against the rear side of the associated inkjet print head 110. The draw hook 120 is pushed in completely and the tension spring 127 is shortened to a minimum. The two-armed guide lever 124 is formed with its shorter upper lever arm end integrally in the associated recess of the draw hook 120, and bears against a round groove of the carrier rear wall 1265 with its longer lower lever arm end. A lug which lies in the engagement region of the guide web 1131 is formed integrally and transversely on the lever arm end.

Detail B shows the positional relationships in the region of the module chip 114 and above. The printing module 11 bears against the end face of the spring pin 12653 by way of its locking lug 115 with a force-transmitting connection, with the result that said spring pin 12653 dips completely into the carrier rear wall 1265. The module chip 114 and its counterpart 12652 are in contact with one another.

Figure 6:
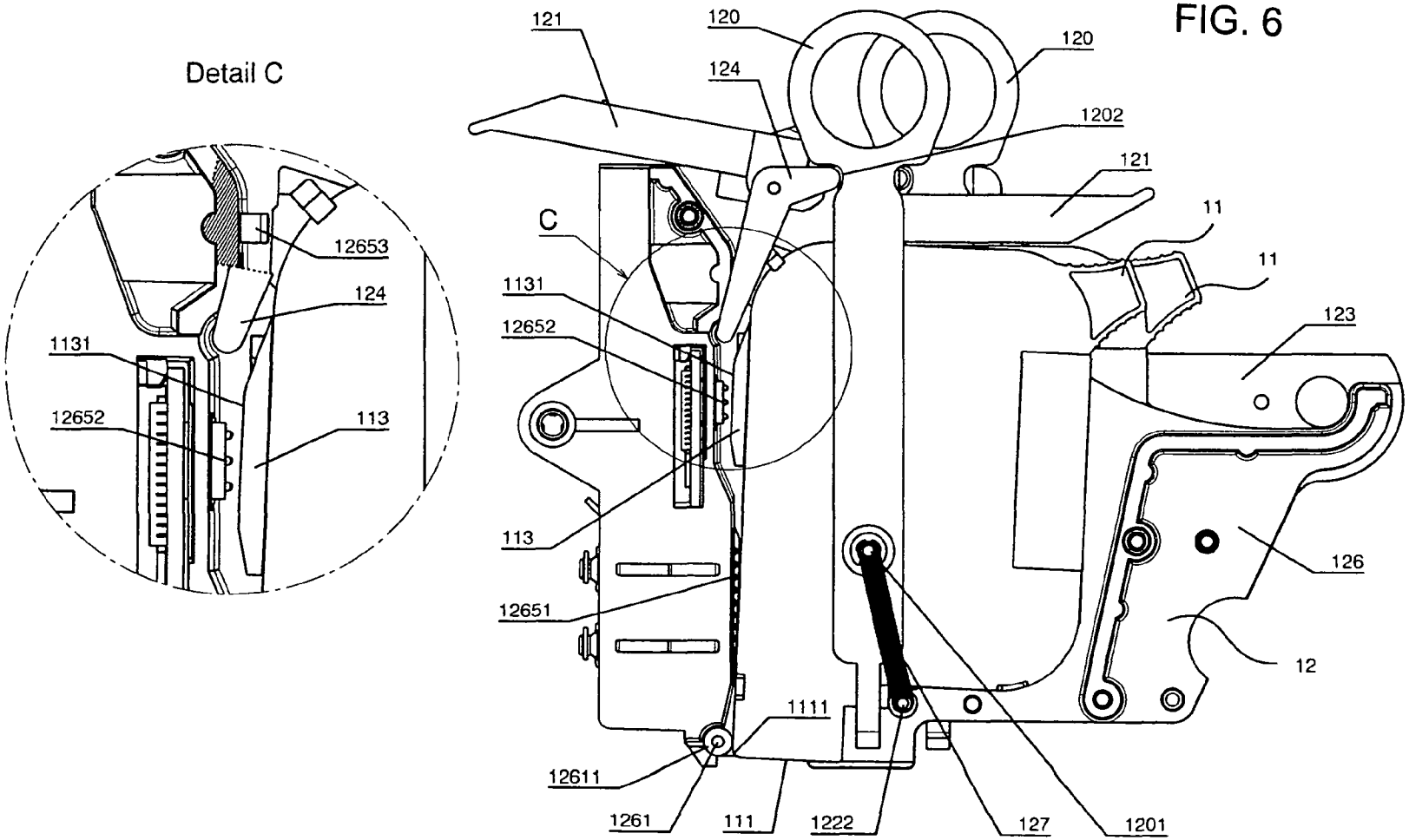
FIG. 6 shows a side view of the receptacle having printing modules which are pushed in completely, one of them being unlocked and the other being locked, with a side wall removed, as viewed from the left with a further detail of the locking mechanism.

In FIG. 6, the bolt 121 is folded back completely and the left-hand inkjet printing module 11 is therefore unlocked but still pressed completely into the receptacle 12; the same is true of the draw hook 120.

As can be seen in detail C, the spring pin 12653 is therefore released and presses the inkjet printing module forward to such an extent that the contact between the module chip 114 and the counterpart 12652, and between the contact field 112 and the counterpart 12651, is canceled. This effect is assisted further by the spring piece 12654.

Figure 7:
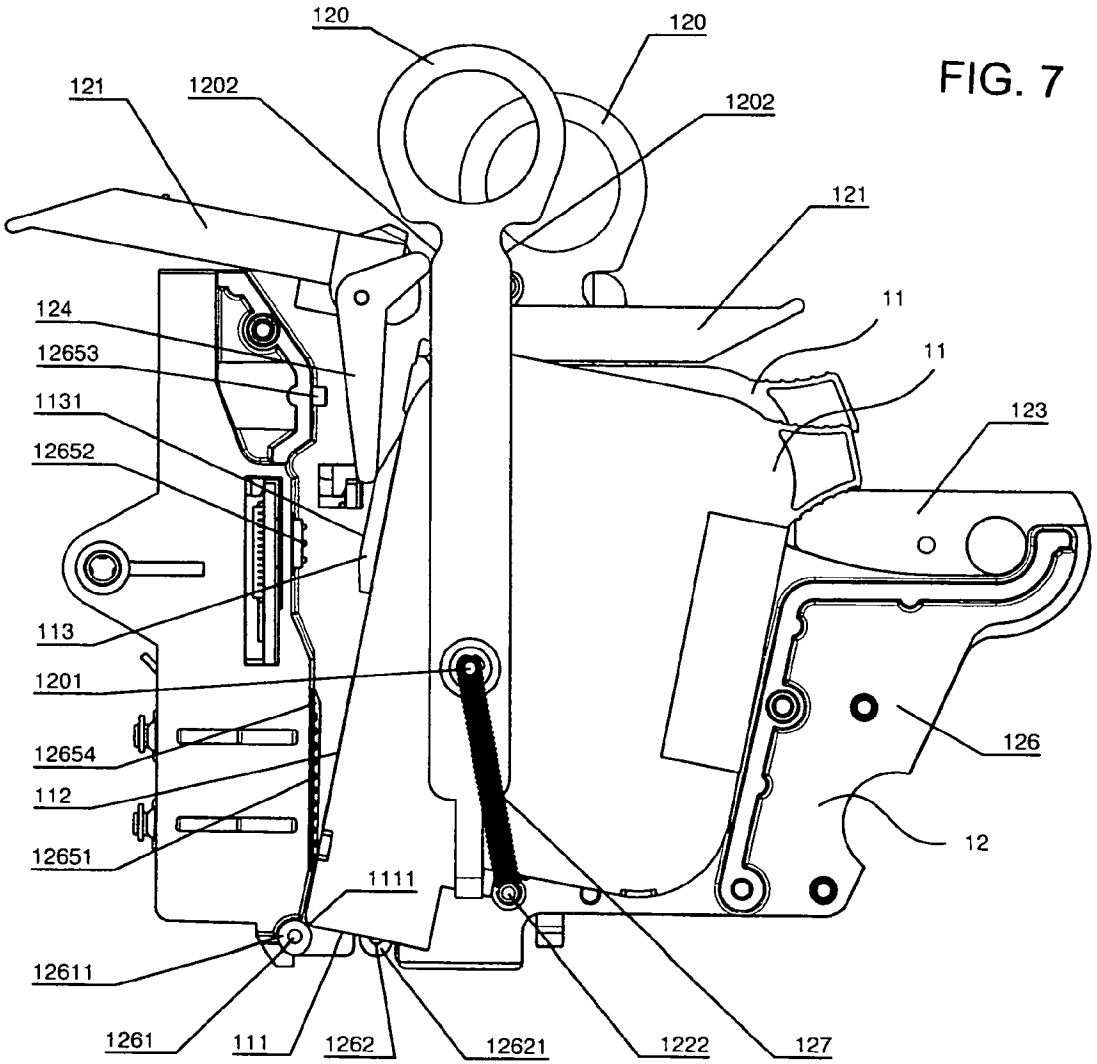
FIG. 7 shows the receptacle according to FIG. 6, having a tilted printing module.

In FIG. 7, the draw hook 120 is pulled up to such an extent that the guide lever 124 with its shorter upper lever arm end leaves the associated recess of the draw hook 120 and bears against its linear part. Here, the guide lever 124 slides along the guide web 1131 of the chip holder 113 by way of the lug of the longer lower lever arm end. The inkjet printing module 11 is pressed forward by the action of the guide lever 124 to such an extent that its front side bears against a front wall (not shown in greater detail) of the receptacle 12, which front wall is inclined forward. The spring piece 12654 becomes completely free and the contact between the contact field 112 and the counterpart 12651 is canceled. The lower rear edge 1111 of the nozzle surface 111 of the inkjet printing module 11 slides past the covering 12621 and is freed from abovementioned ink residues in the process.

Figure 8:
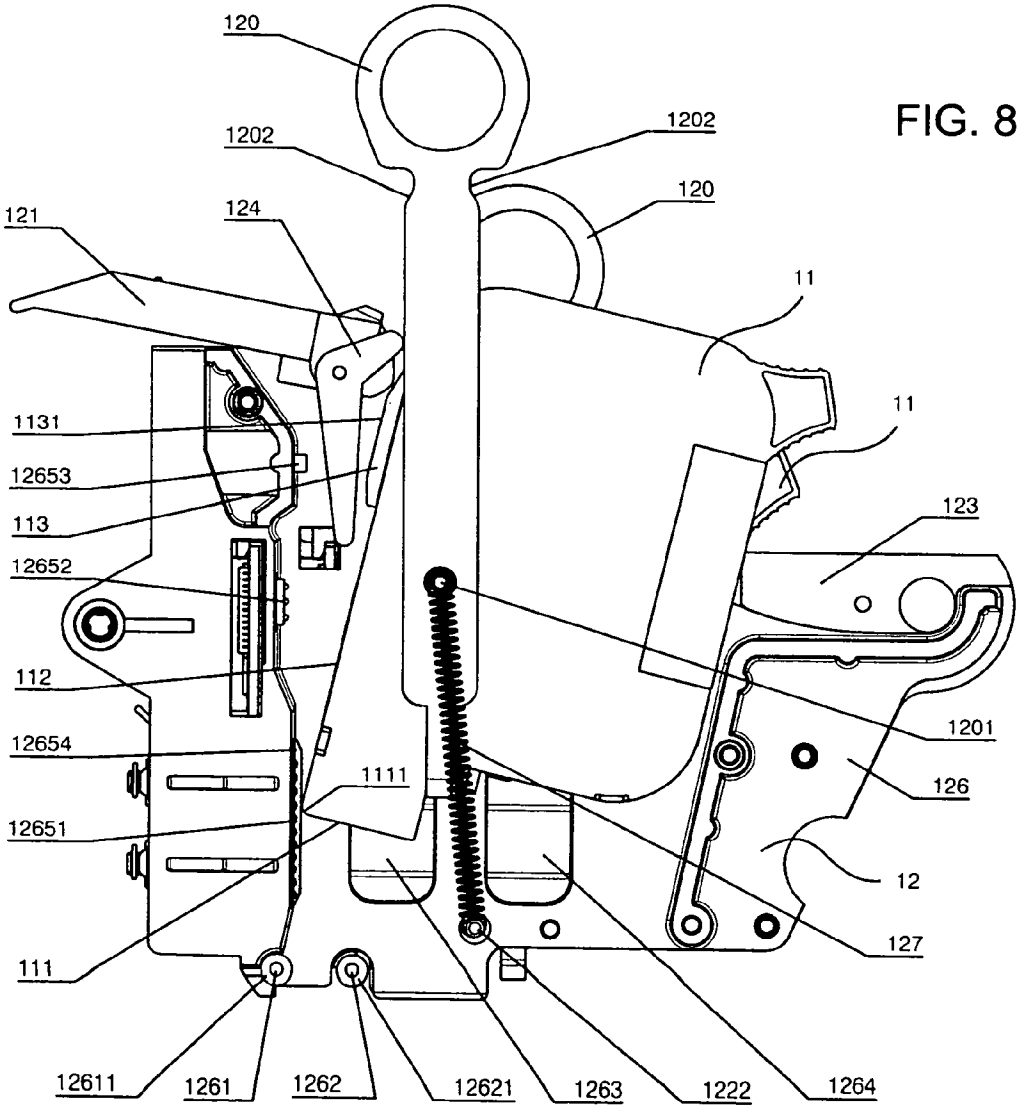
FIG. 8 shows the receptacle according to FIG. 7, having a completely pulled draw hook and a printing module which is ready for gripping.
Figure 9:
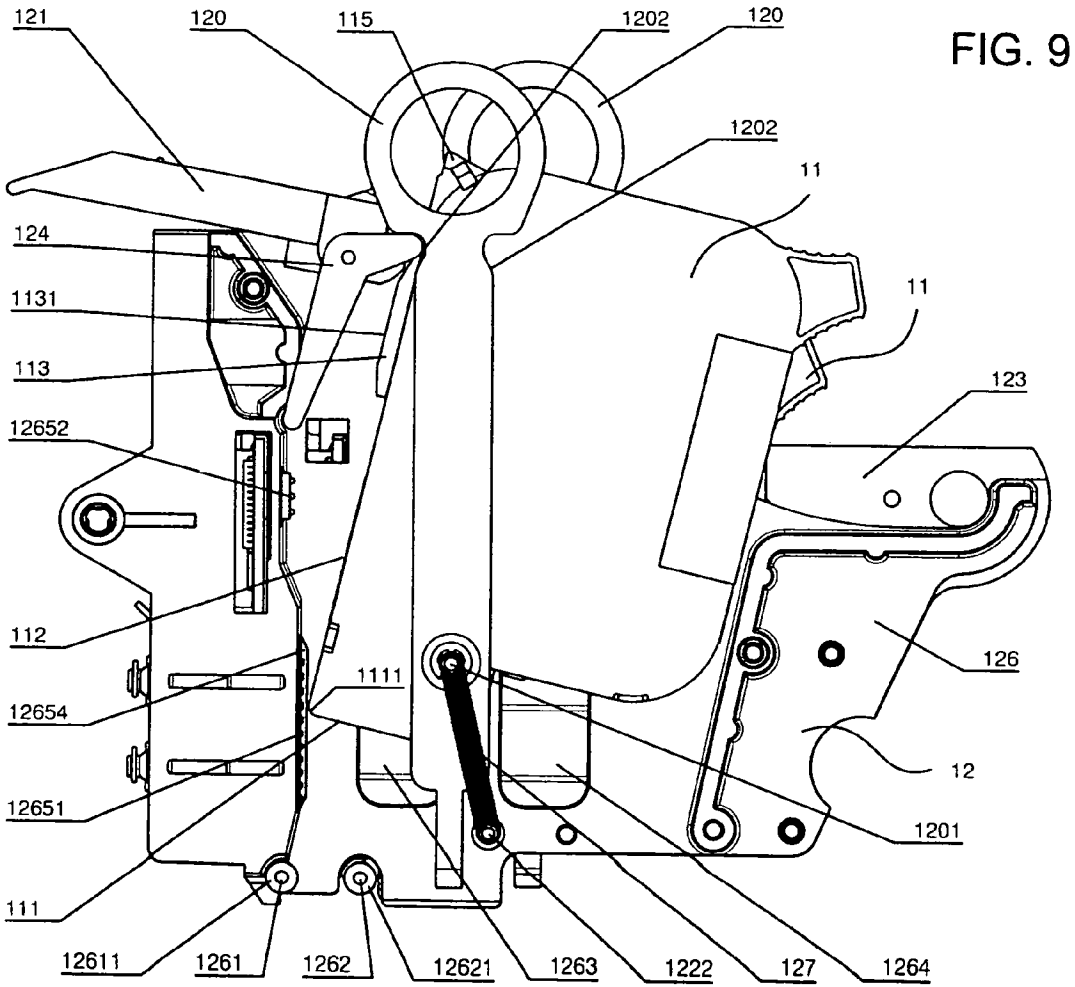
FIG. 9 shows the receptacle according to FIG. 8, having a draw hook which has been guided back into the initial position and a printing module which is ready for gripping.

In FIG. 8, the draw hook 120 is pulled up as far as the upper stop within the slot 1225, see also FIG. 3. Here, the lower rear edge 1111 of the nozzle surface 111 of the inkjet printing module 11 bears against the spring piece 12654 which prevents contact of the counterpart 12651 with respect to the contact field 112. The inkjet printing module 11 now protrudes out of the receptacle 12 to such an extent that it can be gripped comfortably by hand. The draw hook 120 is returned to its initial position by the tension spring 127, the inkjet printing module 11 remaining in its final position, see FIG. 9.

As a result of the measures which are described in the above text, readily accessible pulling of the inkjet printing module 11 by means of drawing hooks 120 is possible firstly. Secondly, wear on the contact surfaces is prevented as a result of the combination of the draw hook 120 with the guide lever 124, 125, the spring pin 12653 and the spring piece 12654, and guide webs 1131 on the chip holder 113. Finally, additional protection of the contact surfaces against ink residues is also achieved by a wiping apparatus (pin 1262 with covering 12621) for the rear edge 1111 of the nozzle surface 111 of the inkjet print head 110.

The invention claimed is:

1. A configuration for exchanging inkjet printing modules in a franking and/or addressing machine, comprising:

a shaft-shaped receptacle with a locking lug for an inkjet printing module, the inkjet printing module including an inkjet print head with a nozzle surface, a rear edge of the nozzle surface, and a chip and a contact field disposed on a narrow side adjacent the nozzle surface;

said receptacle being disposed behind a guide plate formed with a printing window, wherein printing media are guided along the guide plate for printing with the inkjet printing module;

said receptacle having side walls and substantially vertical recesses formed in said side walls;

devices, in said receptacle, for pulling and decontacting the inkjet printing module, said devices being mechanically coupled to one another such that, when pulling is initiated, decontacting is effected at the same time;

a wiping apparatus disposed in a pivoting region of the rear edge of the nozzle surface of the inkjet print head;

a draw hook for pulling the inkjet printing module disposed in an elastically adjustable manner in one of said vertical recesses of said side walls, said draw hook protruding out of said receptacle with a gripping opening and bearing by way of a rear end-side contour against an end of a shorter upper lever arm of a rotatably mounted two-armed guide lever, protruding with an end of a longer lower lever arm thereof into an adapted contour of a carrier rear wall of a carrier of said receptacle;

said draw hook being formed with a recess at the other end of said rear end-side contour adapted to a contour of an end of the shorter lever arm of said guide lever, into which recess said guide lever is latched in a case of a pressed draw hook; and a spring pin mounted in a carrier rear wall orthogonally with respect thereto, said spring pin, when the ink jet printing module is pushed in completely, bearing against a locking lug with a force-transmitting connection.

2. The configuration according to claim 1, which comprises a vertically extending spring piece let into a carrier rear wall within a counterpart to said contact field of said inkjet printing module, said spring piece, during unlocking, additionally serving to space said contact field from said counterpart.

3. The configuration according to claim 1, wherein said draw hook is provided, at an end facing away from said gripping part, with a pin guided in an oblong slot of said side wall of said receptacle, and wherein a tension spring fastened at the other end to a journal is attached at a free end of said pin.

4. The configuration according to claim 1, which comprises a plurality of leaf-shaped guide springs for laterally guiding the inkjet printing modules in a lower region of said side walls and a center wall of said carrier.

* * * * *